US008672254B2

(12) United States Patent
Smith

(10) Patent No.: US 8,672,254 B2
(45) Date of Patent: Mar. 18, 2014

(54) WIRE COILING DEVICE

(76) Inventor: Richard A. Smith, Madison, ME (US)

( * ) Notice: Subject to any disclaimer, the term of this patent is extended or adjusted under 35 U.S.C. 154(b) by 478 days.

(21) Appl. No.: 13/079,991

(22) Filed: Apr. 5, 2011

(65) Prior Publication Data

US 2012/0256035 A1 Oct. 11, 2012

(51) Int. Cl.
*B65H 54/56* (2006.01)

(52) U.S. Cl.
USPC ..... 242/472.5; 242/476.6; 242/486.6; 242/587.2; 242/613; 242/614; 242/118.4; 242/125.1

(58) Field of Classification Search
CPC ..... B65H 65/00
USPC ..... 242/476.6, 484.6, 486.6, 486.8, 486.9, 242/487, 532, 532.6, 540, 546.1, 548, 579, 242/587, 587.2, 600, 613, 614, 118, 118.4, 242/125–125.1, 902, 916, 129, 476.1, 472, 242/472.5; 140/71 C
See application file for complete search history.

(56) References Cited

U.S. PATENT DOCUMENTS

| | | | | |
|---|---|---|---|---|
| 4,196,864 | A * | 4/1980 | Cole | 242/608.5 |
| 7,007,442 | B1 * | 3/2006 | Fogle | 53/393 |
| 7,104,492 | B1 | 9/2006 | Massell et al. | |
| 2004/0108404 | A1 * | 6/2004 | Wiermaa | 242/532.6 |

* cited by examiner

*Primary Examiner* — William E Dondero
(74) *Attorney, Agent, or Firm* — Anthony D. Pellegrini

(57) ABSTRACT

A device for winding a length of wire into one or more flat coils, with the device having a winding component onto which the wire is wound, a wire guide to contain the coils of the wire into a single width flat coil, and a drive engagement component adapted to be engaged by a drive means such that the drive means operates the winding component of the device. In one embodiment of the device the winding component is a cylindrical capstan having a receiving slot adapted to engage the end of the wire, the drive means is an electric hand drill, the drive engagement component is a shaft integrated with and extending from the capstan and adapted to be inserted into the chuck of the electric hand drill, and the wire guide has two spaced apart parallel members adapted to accommodate the capstan in the space between them, whereby the parallel members guide the coil of the wire into a single width flat coil onto the capstan as the capstan is rotated by the electric drill.

10 Claims, 8 Drawing Sheets

WIRE COILING DEVICE

BACKGROUND OF THE INVENTION

1. Technical Field

The present invention relates generally to the field of tools and accessories used by utility linemen. More specifically, the present invention is directed to an improved device for coiling tie wire into single width flat coils.

2. Description of Prior Art

Utility linemen often must perform installation, repair, and maintenance work on equipment mounted on utility poles. In one aspect of this work, components such as conductors are secured to pin insulators in overhead transmission and distribution lines by tie wire. The tie wire, which is typically soft solid aluminum or copper wire, either bare or covered with an insulating coating, is hand twisted around the components to be secured. However, because tie wire is typically semi-rigid, meaning that while it can be bent it otherwise remains in a rigid condition, the use of any appreciable length of wire presents a potential hazard to the lineman using it. A typical length of tie wire is six feet; when manipulating one end to secure a component, the free end may extend several feet and may come in contact with live electrical transmission lines, other wires, or any other objects that may be grounded or not covered with insulation, potentially causing short circuits or electrocution and resulting in injury or death and damage to equipment.

To avoid these hazards, linemen have traditionally hand coiled tie wire in advance of ascending utility poles. The tie wires are normally coiled from each end toward the middle into a pair of single width flat coils, thereby preventing excess wire from extending more than a few inches. The resulting coils are compact and easy to carry and use while minimizing the risk of hazard when the tie wire is being wrapped around components.

Hand coiling tie wire, however, is slow and tedious work. Linemen may need to coil hundreds of tie wires in advance of going into the field; hand coiling such a large number of tie wires may result in painful hand or wrist injuries, as well as the loss of appreciable amounts of time. The results of hand coiling tie wire may also be sloppy, with the coils being uneven or overlapping themselves, making them less useful in the field. Notwithstanding the foregoing, the applicant is unaware of the existence of any device to assist linemen in coiling tie wire.

It is therefore shown that there is a need for a more efficient means for coiling tie wire.

It is thus an object of the present invention to provide a device for coiling tie wire into single width flat coils.

It is a further object of the present invention to provide a device for coiling tie wire into single width flat coils that is simple to use.

It is yet a further object of the present invention to provide a device for coiling tie wire into single width flat coils that is more efficient than hand coiling.

It is yet a further object of the present invention to provide a device for coiling tie wire into single width flat coils that is inexpensive to manufacture.

It is yet a further object of the present invention to provide a device for coiling tie wire into single width flat coils that may use powered means to create the coils.

Other objects of the present invention will be readily apparent from the description that follows.

SUMMARY OF THE INVENTION

The present invention comprises a device for coiling a length of tie wire into single width flat coils. The device has a winding component onto which the tie wire is wound, a wire guide to contain the coils of the tie wire into a single width flat coil, and a drive engagement component adapted to be engaged by a drive means such that the drive means rotates the winding component of the device.

In one embodiment of the device the winding component is a cylindrical capstan having a receiving slot adapted to engage and secure the end of the wire. The drive means may be a powered device, such as an electric hand drill or a power screw driver. The drive engagement component may be a shaft integrated with and extending from the capstan and adapted to be inserted into the chuck of the electric hand drill or power screw driver. The wire guide comprises a pair of spaced apart parallel members. The space between the parallel members is just slightly wider than the diameter of the tie wire to be wound. The capstan is accommodated by the parallel members in the space between them. The longitudinal axis of the capstan is oriented perpendicular to the parallel members. During rotation of the capstan the parallel members guide the coil of the tie wire into a single width flat coil onto the capstan, with the free end of the tie wire extending from between the parallel members.

In alternative embodiments the drive engagement component may be a slot or a cruciform pair of intersecting slots formed into the end of the capstan. The drive means then uses a bit, either a flat head or a Phillips head, as appropriate, to engage the capstan.

The parallel members are held together with spacers. The spacers may be fixed or removable from one or both of the parallel members. Having removable spacers allows for easy assembly and disassembly of the device, for ease of removal of the coiled wire, and also allows different sized spacers to be used to accommodate different gauge wire.

The device works as follows: the end of the tie wire is inserted between the parallel members and placed into the receiving slot of the capstan. The drive means is attached to the capstan. As the capstan is rotated by the drive means the sides and edges of the receiving slot engage the end of the tie wire, preventing it from being pulled out of the receiving slot and pulling the tie wire onto the outer surface of the capstan. The tie wire then wraps around the capstan for one revolution. As the capstan continues to be rotated the tie wire begins to coil over previously coiled tie wire. Because the space between the parallel members is only slightly wider than the diameter of the tie wire, as the tie wire is coiled it does not slip down alongside the previously coiled tie wire and so a single width flat coil is formed. When approximately half of the length of tie wire is coiled, the coil is removed from the device and the process is repeated for the opposite end of the tie wire. As the user becomes more adept at using the device the speed of the drive means may be increased, thereby decreasing the time needed to create the double coiled finished product.

Other features and advantages of the present invention are described below.

DETAILED DESCRIPTION OF THE INVENTION

The present invention discloses a device 1 for winding wire 10, specifically soft solid aluminum or copper tie wire of the type used by utility linemen to mechanically secure components of overhead transmission and distribution lines, such as conductors to pin insulators. The wire 10 may be either bare or plastic covered. Tie wire 10 comes in multiple grades and thicknesses. It is typically semi-rigid, meaning that it can be easily bent and it remains bent (i.e., it has little or no memory).

Figure 1:
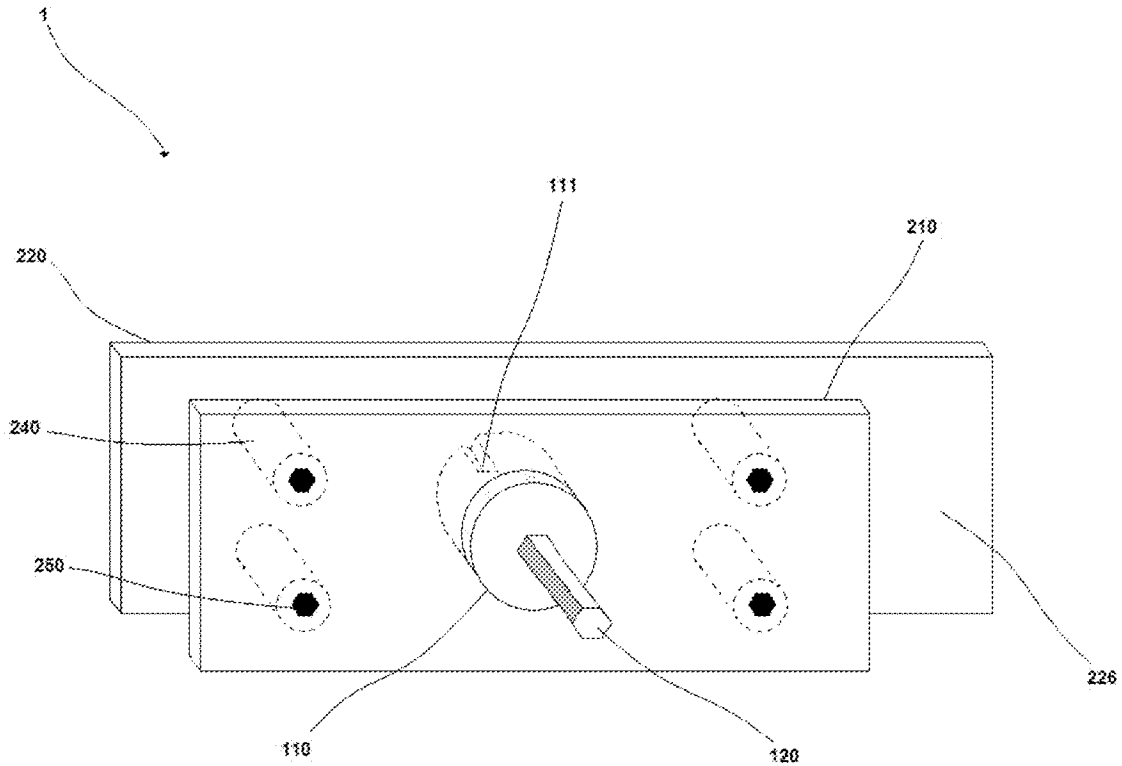
FIG. 1 is a perspective side view of one embodiment of the device of the present invention. Ghost lines are provided to illustrate structures that would be otherwise hidden.

The device 1 of the present invention comprises a winding component 100 and a wire guide 200. See FIG. 1. The winding component 100 engages the wire 10 and winds it into a coil through rotational means. The wire guide 200 forces the wire 10 into a substantially flat coil configuration.

Figure 4B:
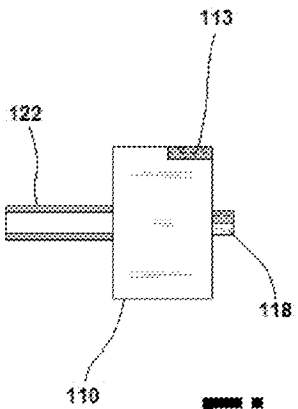
FIG. 4B is a plan side view of the embodiment of the capstan of the device of the present invention depicted in FIG. 4A.
Figure 4C:
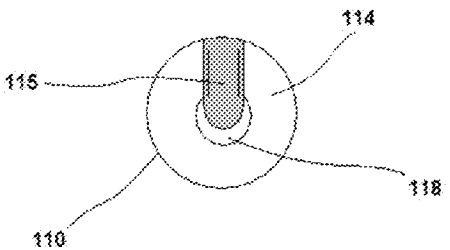
FIG. 4C is a plan front view of the embodiment of the capstan of the device of the present invention depicted in FIG. 4A.
Figure 4A:
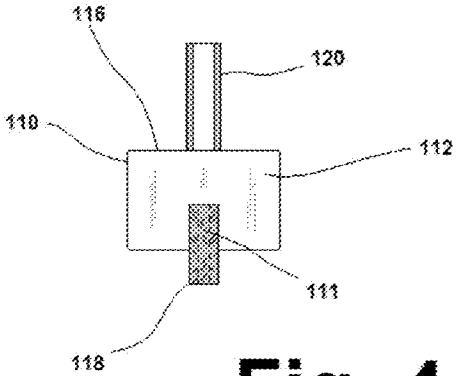
FIG. 4A is a plan top view of one embodiment of the capstan of the device of the present invention.

The winding component 100 of the device 1 of the present invention comprises a capstan 110 and a drive engagement component 120. See FIGS. 4A, 4B, and 4C. The capstan 110 is substantially cylindrical and the wire 10 is wound thereupon. In the preferred embodiment the capstan 110 is a solid body, ideally manufactured of metal such as aluminum, but other rigid, durable materials may also be used, such as plastic, composites, wood, and the like. Alternatively, the capstan 110 may be hollow. The outer circumferential surface 112 of the capstan 110 should be substantially smooth. The ends 114,116 of the capstan 110 are preferably substantially planar and parallel to each other, and oriented substantially perpendicular to the longitudinal axis of the cylinder. Described as such, the basic dimension of the capstan 110 are as follows: the capstan 110 may have any suitable diameter, with the preferred diameter being between 0.75 inches and 2.0 inches, with the most preferred diameter being 1.25 inches; the capstan 110 may also have any suitable length, measured from one planar end to the other, with the preferred length being between 0.5 inches and 2.5 inches, with the most preferred length being 0.75 inches.

Figure 5:
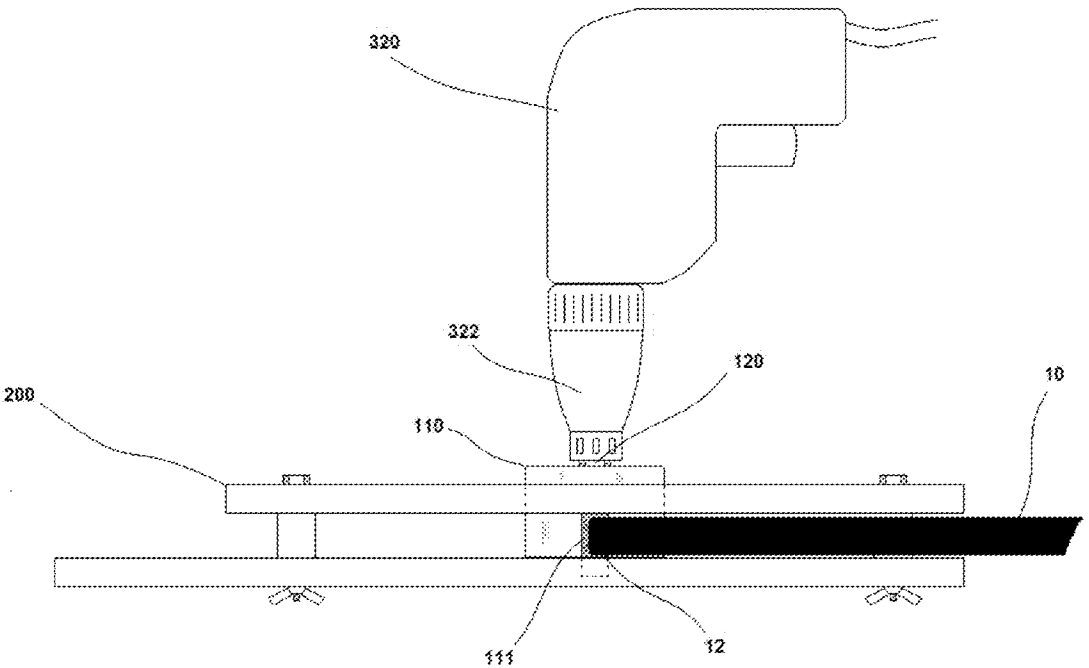
FIG. 5 is a plan top view of the embodiment of the device of the present invention depicted in FIG. 1, with one embodiment of the drive means engaging the drive engagement component and one end of a wire inserted into the receiving slot. Ghost lines are provided to illustrate structures that would be otherwise hidden.

To engage the wire 10, the capstan 110 has a receiving slot 111. See FIGS. 4A, 4B, and 4C. The receiving slot 111 is suitably adapted to receive an end 12 of the wire 10. See FIG. 5. The receiving slot 111 is located proximate to the first planar end 114 of the capstan 110. It should be substantially perpendicular to the longitudinal axis of the capstan 110 and forms an aperture 113 through the outer surface 112 of the capstan 110 and into the interior of the capstan 110. Preferably, the receiving slot 111 also forms an aperture 115 in the first end 114 of the capstan 110 contiguous with the aperture 113 in the outer surface 112 of the capstan 110. Thus, an end 12 of the wire 10 may be inserted into and removed from the receiving slot 111 through either the aperture 113 in the outer surface 112 of the capstan 110 or through the aperture 115 in the first end 114 of the capstan 110, or both. In practice, the end 12 of the wire 10 will be inserted into the receiving slot 111 through the aperture 113 in the outer surface 112 of the capstan 110 before the wire 10 is wound; after the wire 10 is wound, the end 12 of the wire 10 will be removed from the receiving slot 111 through the aperture 115 in the first end 114 of the capstan 110. That is, insertion of the wire 10 will typically involve moving the end 12 of the wire 10 into the receiving slot 111 in a direction substantially perpendicular to the longitudinal axis of the capstan 110 while removal of the wire 10 will typically involve moving the end 12 of the wire 10 laterally out of the receiving slot 111 in a direction substantially parallel to the longitudinal axis of the capstan 110. This is because once the wire 10 is wound onto the capstan 110 it cannot be withdrawn in a direction perpendicular to the longitudinal axis of the capstan 110 but rather must be slid off the first end 114 of the capstan 110.

The receiving slot 111 ideally has a cross section slightly greater than the cross section of the wire 10 to be wound. This allows both bare and covered wire 10 to be wound by the device 1. The cross section of the receiving slot 111 may be circular, rectangular, or any other suitable shape. The depth of the receiving slot 111, measured from the outer surface 112 of the capstan 110, can be any suitable depth sufficient to hold the end 12 of the wire 10 in place during the winding operation. Preferably, the depth should be not less than one fourth of the diameter of the capstan 110 and not more than three fourths of the diameter of the capstan 110. Most preferably, the depth is one half the diameter of the capstan 110.

The drive engagement component 120 of the winding component 100 is suitably adapted to be engaged by a drive means 300 such that the drive means 300 is capable of rotating the capstan 110. The drive engagement component 120 is preferably in connection with the capstan 110, and most preferably is integrated with the second end 116 of the capstan 110. In the preferred embodiment the drive engagement component 120 is a shaft 122 that extends outward from the second end 116 of the capstan 110 and is oriented substantially perpendicular to the second end 116 of the capstan 110. The shaft 122 is located substantially along the longitudinal axis of the capstan 110. The drive means 300 engages with the shaft 122 and rotates the shaft 122, causing the capstan 110 to rotate. In the most preferred embodiment the shaft 122 has a hexagonal cross section. In this embodiment the drive means 300 may be an electric motor which fits over the end of the shaft 122. Alternatively, the drive means 300 may be a hand crank that fits over the end of the shaft 122. In the most preferred embodiment the drive means 200 is an electric drill 320 having a chuck 322, with the end of the shaft 122 adapted to be inserted into the chuck 322 of the electric drill 320. See FIG. 5. Operation of the electric drill 320 causes the shaft 122 to rotate, thereby rotating the capstan 110.

Figure 6A:
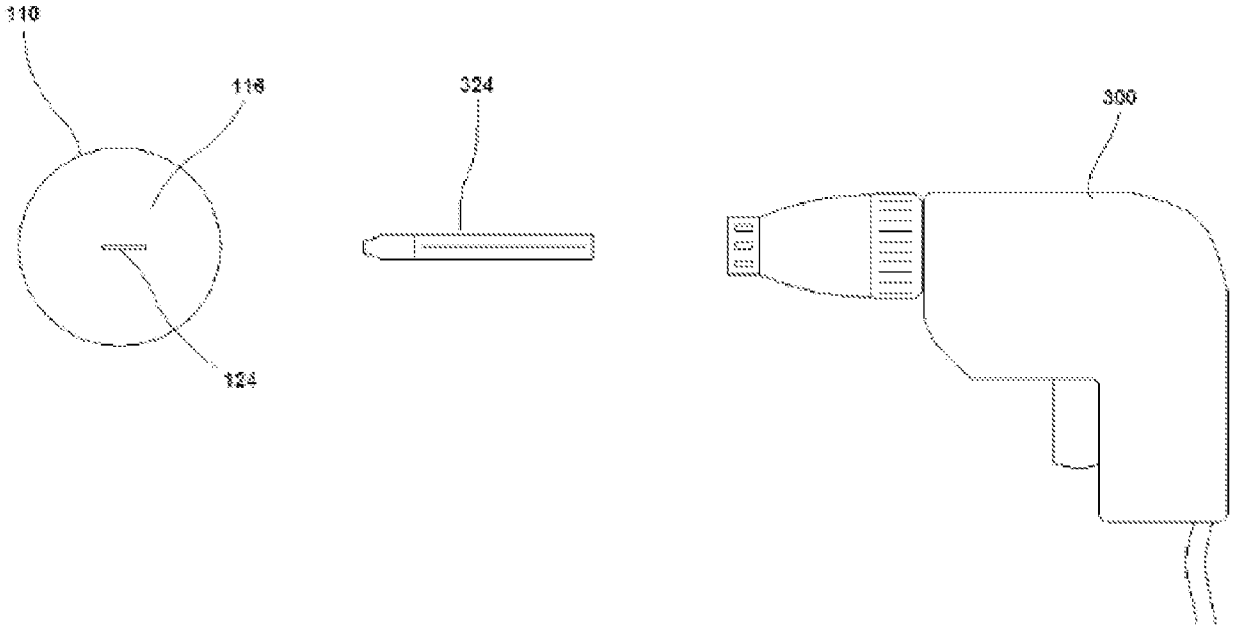
FIG. 6A depicts an alternate drive engagement component and drive means of the device of the present invention.
Figure 6B:
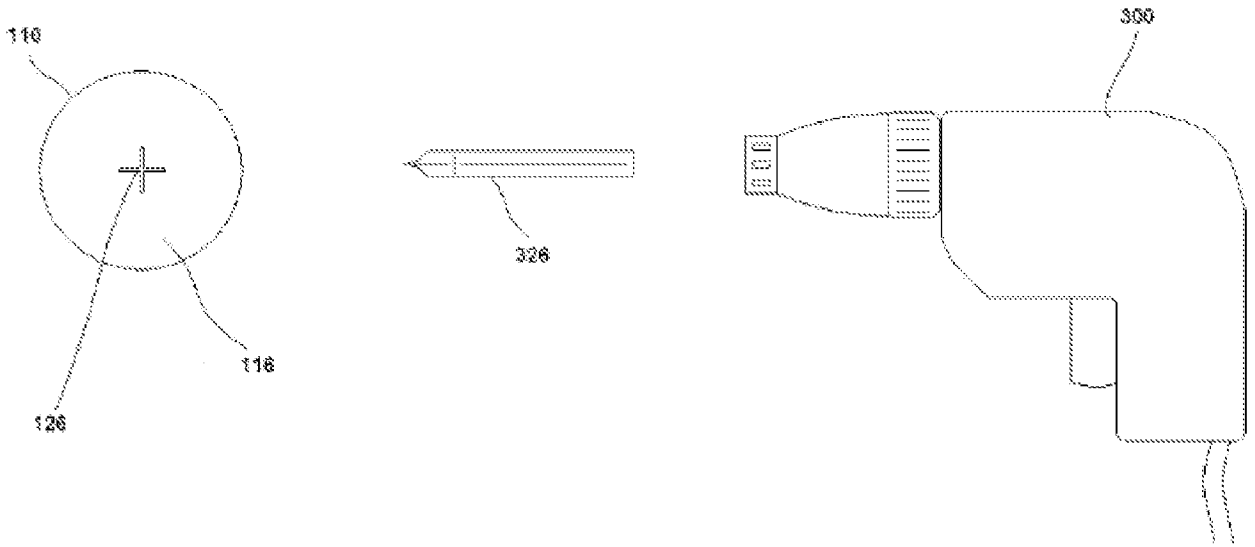
FIG. 6B depicts yet another alternate drive engagement component and drive means of the device of the present invention.

In alternate embodiments the drive engagement component 120 may be a slot 124 formed into the second end 116 of the capstan 110. See FIG. 6A. The slot 124 is centered substantially over the longitudinal axis of the capstan 110. In such embodiments the drive means 300 may be an electric drill 320 having a flat head screw driver bit 324. The drive bit 324 is inserted into the slot 124 and operation of the electric drill 320 causes the capstan 110 to rotate. In yet other alternate embodiments the drive engagement component 120 may be a pair of intersecting slots 126 in cruciform orientation to each other formed into the second end 116 of the capstan 110. See FIG. 6B. The pair of slots 126 is centered substantially over the longitudinal axis of the capstan 110. In such embodiments the drive means 300 may be an electric drill 320 having a Phillips head screw driver bit 326. The drive bit 326 is inserted into the intersecting slots 126 and operation of the electric drill 320 causes the capstan 110 to rotate. In all of these embodiments the drive means 300 may alternatively be a powered screw driver, or an electric motor, or a hand crank, each of which uses the respective drive bit 324,326 as described herein.

Figure 2:
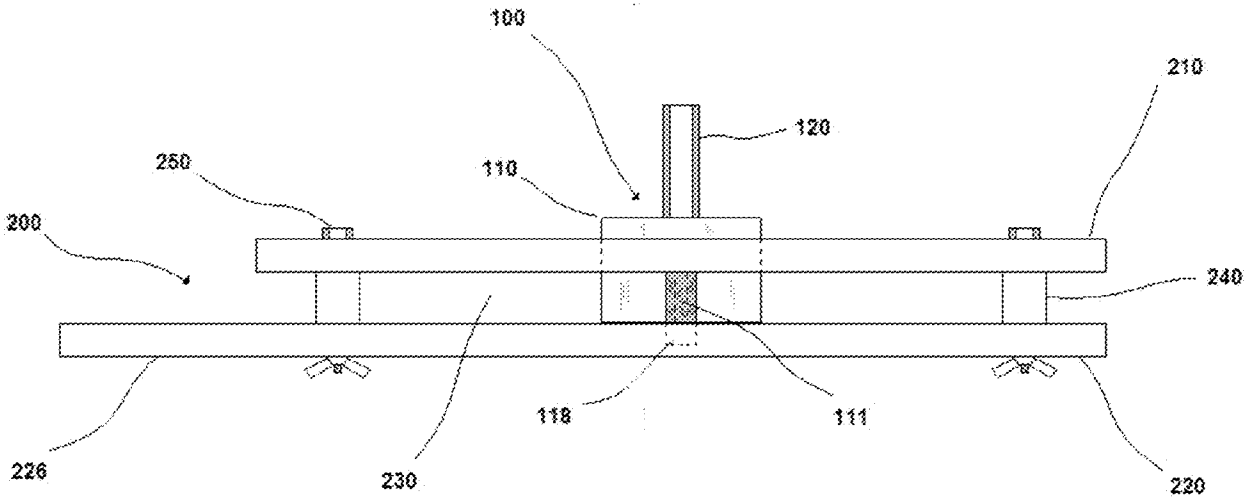
FIG. 2 is a plan top view of the embodiment of the device of the present invention depicted in FIG. 1. Ghost lines are provided to illustrate structures that would be otherwise hidden.
Figure 3:
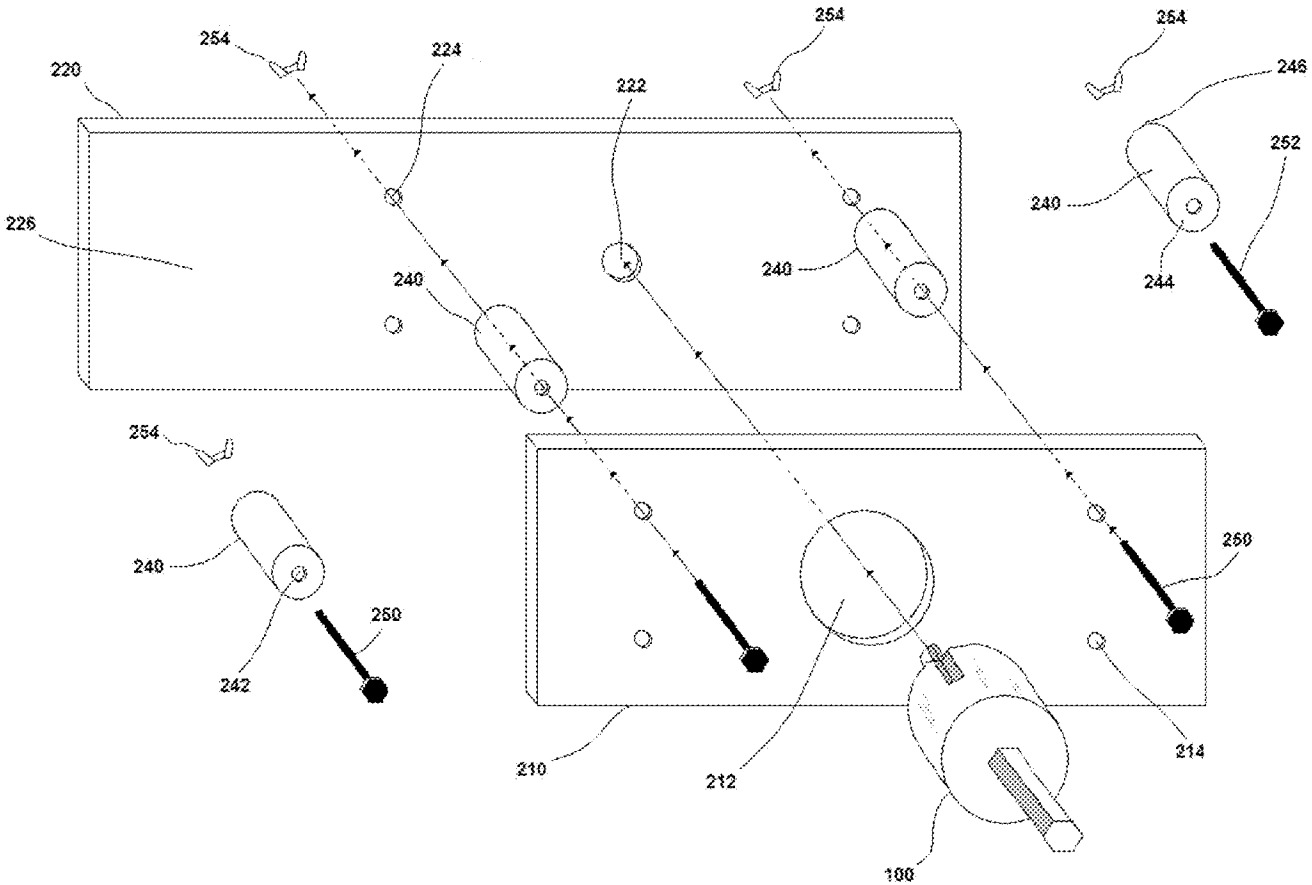
FIG. 3 is an exploded perspective side view of one embodiment of the device of the present invention depicted in FIG. 1, with arrows showing how certain elements are assembled.

The wire guide 200 of the device 1 of the present invention comprises any suitable structure which can engage the winding component 100 and guide the wire 10 around the winding component 100 during operation such that the wire 10 is wound into a substantially flat coil. In the preferred embodiment the wire guide 200 comprises a first guide member 210 and a second guide member 220. See FIGS. 1, 2, and 3. The first and second guide members 210,220 are substantially planar and are oriented substantially parallel to each other. The first and second guide members 210,220 may be of any shape, though the preferred shape for both is rectangular. The first and second guide members 210,220 may be similarly dimensioned, or differently dimensioned. In the most preferred embodiment the first and second guide members 210, 220 are rectangular, both having substantially the same width but with the second guide member 220 having a longer length. This extended length 226 of the second guide member 220 provides an engagement point for a clamp, so that the device 1 can be held in place during use. The first and second guide members 210,220 may be made of any suitable, rigid material, such as plastic, metal, composites, wood, glass, acrylic, and the like. In the most preferred embodiment the first and second guide members 210,220 are made of high density polyethylene plastic (HDPE).

The first and second guide members 210,220 are spaced apart from each other, creating an internal wire guide space 230 between them. See FIG. 2. The internal wire guide space 230 should be just slightly wider than the external diameter of the wire 10. During winding, the wire 10 is placed between the first and second guide members 210,220 and as the wire 10 is wound onto the capstan 110 the wire 10 coils onto itself in a relatively flat coil. See FIG. 5. If the internal wire guide space 230 is too wide the wire 10 may slip off itself during winding and create stacked coils. If the internal wire guide space 230 is too narrow the wire 10 may bind between the first and second guide members 210,220. In the preferred embodiment the internal wire guide space 230 is one and one quarter times the diameter of the wire 10. This allows for winding of both bare and covered wire 10 of the same gauge.

The wire guide 200 engages the winding component 100 in the preferred embodiment by employing an aperture 212 in the first guide member 210. See FIG. 3. The aperture 212 is substantially circular and has an inside diameter substantially the same as the outside diameter of the capstan 110. The capstan 110 is adapted to be inserted into and through the aperture 212 of the first guide member 210 such that a portion of the capstan 110 is retained in the aperture 212 of the first guide member 210 and another portion of the capstan 110 extends into the internal wire guide space 230. See FIG. 2. The first end 114 of the capstan 110 is thus proximate to the second guide member 220 and the second end 116 of the capstan 110 extends outside of the internal wire guide space 230. So engaged, the capstan 110 may rotate within the aperture 212 of the first guide member 210. Moreover, the receiving slot 111 of the capstan 110 is located within the internal wire guide space 230 and is accessible from the exterior of the wire guide 200.

In one alternate embodiment the wire guide 200 further engages the winding component 100 by employing an additional aperture in the second guide member 210 (not shown). This aperture is dimensioned substantially the same as the aperture 212 of the first guide member 210 and is aligned therewith. The capstan 110 is adapted to be inserted into and through the aperture of the second guide member 220 such that a portion of the capstan 110 is retained in the aperture of the second guide member 220, a portion of the capstan 110 is retained in the aperture 212 of the first guide member 210, and another portion of the capstan 110 extends into the internal wire guide space 230. The first end 114 of the capstan 110 thus extends through the second guide member 220 and the second end 116 of the capstan 110 extends outside of the internal wire guide space 230. So engaged, the capstan 110 may rotate within the aperture 212 of the first guide member 210 and the aperture of the second guide member 220. Moreover, the receiving slot 111 of the capstan 110 is located within the internal wire guide space 230 and is accessible from the exterior of the wire guide 200.

In the preferred embodiment of the present invention, the capstan 110 further comprises a pilot stub 118. See FIGS. 4A, 4B, and 4C. The pilot stub 118 is located on the first end 114 of the capstan 110 proximate to the receiving slot 111. The pilot stub 118 is a substantially cylindrical shaft extending outward from the first end 114 of the capstan 110. It is oriented substantially perpendicular to the first end 114 of the capstan 110 and is located substantially along the longitudinal axis of the capstan 110. The diameter of the pilot stub 118 must be less than the diameter of the capstan 110. The pilot stub 118 serves to provide a second point of contact between the capstan 110 and the wire guide 200 to improve the rotational operation of the winding component 100, and also prevents the capstan 110 from sliding through and out of the wire guide 100 during operation. To accommodate the pilot stub 118, the second guide member 220 has a corresponding aperture 222 adapted to receive the pilot stub 118 when the capstan 110 is inserted into the wire guide 200. The aperture 222 in the second guide member 220 is substantially circular and has a diameter substantially the same as the diameter of the pilot stub 118. When the capstan 110 is properly inserted into the wire guide 200 the pilot stub 118 is seated within the aperture 222 of the second guide member 220 and a portion of the capstan 110 is seated within the aperture 212 of the first guide member 210. See FIG. 2. During operation the capstan 110 and pilot stub 118 rotate within their respective guide member apertures 212,222. The use of a pilot stub 118 adds to the stability of the rotation of the capstan 110 during the winding operation. In the most preferred embodiment the receiving slot 111 extends into the pilot stub 118, whereupon there is a channel along the upper portion of the pilot stub 118 contiguous with the receiving slot aperture 115 of the first end 114 of the capstan 110. This allows for greater ease in removal of the wire 10 once it is wound about the capstan 110.

The first and second guide members 210,220 are spaced apart from each other by the use of a multiplicity of spacers 240. See FIGS. 2 and 3. The spacers 240 each have a first end 244 and a second end 246 and a length substantially the same as the length of each other spacer 240. The spacers 240 may be made of any suitable, rigid material, such as plastic, metal, composites, wood, glass, acrylic, high density polyethylene plastic (HDPE), and the like. In the most preferred embodiment the spacers 240 are made of nylon. Each spacer 240 is located within the internal wire guide space 230 between the first and second guide members 210,220. The first end 244 of each spacer 240 is adjacent to the first guide member 210 and the second end 246 of each spacer 240 is adjacent to the second guide member 220. The spacers 240 may be fixedly attached to either or both of the first and second guide members 210,220. They may be attached by adhesives or mechanical fasteners 250. Alternatively, they may be integrated with either or both of the guide members 210,220, for example, being molded as a monolithic structure.

In the preferred embodiment each of the spacers 240 is removable from either or both of the first and second guide members 210,220. This allows the wire guide 200 to be easily disassembled either to change its configuration or to remove the capstan 110 or to remove the wire 10 from the capstan 110. In the most preferred embodiment each of the spacers 240 is removable from both the first and second guide members 210,220. In this embodiment each spacer 240 is substantially cylindrical and has a central aperture 242 passing completely through it from the first end 244 to the second end 246, with the central aperture 242 being located along the longitudinal axis of the spacer 240. See FIG. 3. The first and second guide members 210,220 each comprises a plurality of connection apertures 214,224 corresponding to the number of spacers 240, with the connection apertures 214 of the first guide member 210 aligned with the connection apertures 224 of the second guide member 220. The connection apertures 214,224 of the first and second guide members 210,220 have substantially the same diameter as each other and as the central apertures 242 of the spacers 240. The spacers 240 are interposed between the first and second guide members 210, 220 such that the central aperture 242 of each spacer 240 is aligned with a corresponding pair of connection apertures 214,224 of the first and second guide members 210,220. For each spacer 240 a fastener 250 is then passed through the corresponding connection aperture 214 of the first guide member 210, through the central aperture 242 of the spacer 240, and through the corresponding connection aperture 224 of the second guide member 220. Any suitable fastener 250 may be used. In the preferred embodiment each fastener 250 is comprised of a threaded bolt 252 and a wing nut 254. See FIG. 3. Bolts with traditional nuts may also be used, as may be cotter pins, and the like.

In one alternate embodiment the wire guide 200 comprises spacers 240 having different sizes, with a multiplicity of spacers 240 of each size. This allows the wire guide 200 to accommodate different gauges of wire 10. That is, a thicker wire 10 will require longer spacers 240 and a thinner wire 10 will require shorter spacers 240. The use of easily removable fasteners 250 such as threaded bolts 252 and wing nuts 254 makes the reconfiguration of the wire guide 200 simple and quick.

Figure 7:
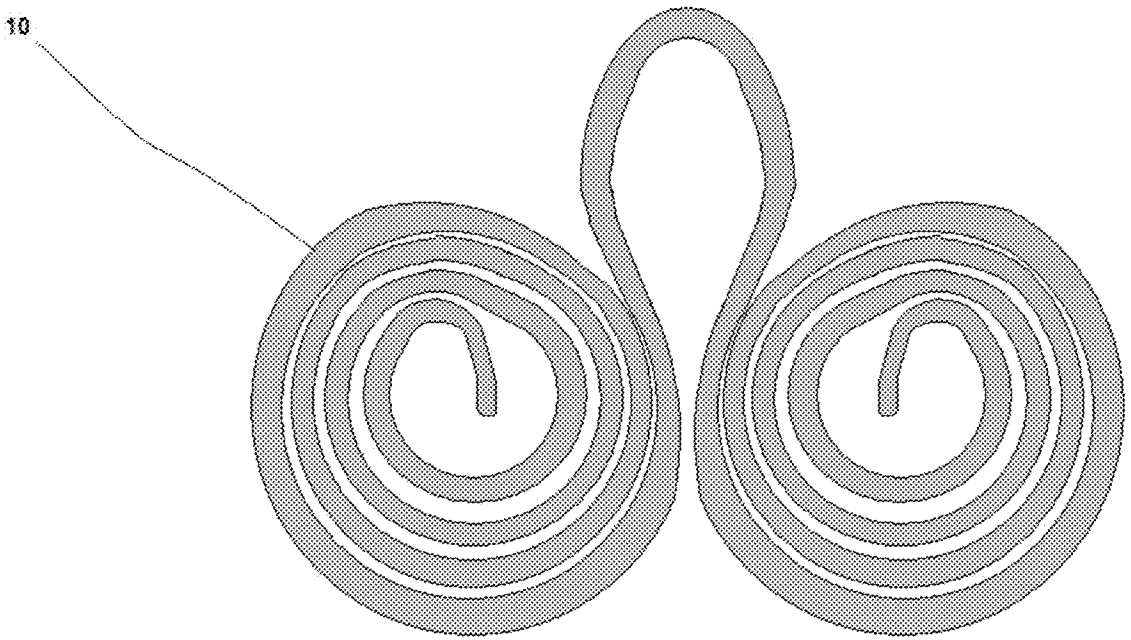
FIG. 7 is a depiction of a double flat coiled wire resulting from operation of the device of the present invention.

In the most preferred embodiment the device 1 of the present invention is used as follows: the wire guide 200 is assembled by selecting the desired sized spacers 240, interposing them between the first and second guide members 210,220, and then fastening them thereto with fasteners 250. See FIG. 3. The wire guide 200 is then secured to a clamp by attaching the clamp to the clamp extension portion 226 of the second guide member 220. The capstan 110 is then placed into the wire guide 200 by inserting the first end 114 of the capstan 110 into and through the aperture 212 of the first guide member 210 and inserting the pilot stub 118 into the aperture 222 of the second guide member 220. A length of wire 10 is then provided, usually six feet in length. One end 12 of the wire 10 is passed between the first and second guide members 210,220 into the internal wire guide space 230 and through the capstan outer surface aperture 113 into the receiving slot 111 of the capstan 110. An electric drill 320 is then attached to the hex shaft 122 extending from the second end 116 of the capstan 110. The drill 320 is operated, rotating the capstan 110 and winding the wire 10 onto the capstan 110. After slightly less than one half of the wire 10 is coiled the drill 320 is stopped and the capstan 110 is slid out of the wire guide 200. Once the capstan 110 is removed the partially coiled wire 10 is withdrawn from the wire guide 200. The capstan 110 is reinserted into the wire guide 200, as before, and the other end 12 of the wire 10 is inserted into the receiving slot 111 of the capstan 110, as described above. The drill 320 is operated in the same manner to wind the remainder of the wire 10. When the remainder is coiled the operation is complete. The capstan 110 is again removed from the wire guide 200 and the doubly coiled wire 10 is removed from the wire guide 200. The wire 10 may be bent at its middle to fashion a central loop for ease of handling. See FIG. 7.

What has been described and illustrated herein is a preferred embodiment of the device 1 of the present invention along with some it its variations. The terms, descriptions and figures used herein are set forth by way of illustration only and are not meant as limitations. Those skilled in the art will recognize that many variations are possible within the spirit and scope of the invention in which all terms are meant in their broadest, reasonable sense unless otherwise indicated. Other embodiments not specifically set forth herein are therefore also within the scope of the following claims.

I claim:

1. A device for winding wire comprising a winding component, said winding component comprising a capstan, said capstan being substantially cylindrical and having a diameter, an outer circumferential surface, a substantially planar first end, and a second end, said capstan further having a receiving slot, said receiving slot suitably adapted to receive an end of said wire, with the receiving slot of the capstan located proximate to said first end of the capstan and distal from said second end of the capstan, with the receiving slot oriented substantially perpendicular to the longitudinal axis of the capstan and forming an aperture through said outer circumferential surface of the capstan adjacent to said first end of the capstan, forming an aperture in said first end of the capstan contiguous with the aperture in said outer circumferential surface of the capstan, with the receiving slot having a cross section slightly greater than a cross section of the wire and a depth of not less than one fourth of the diameter of the capstan and not more than three fourths of the diameter of the capstan, wherein the end of the wire may be inserted into and removed from the receiving slot through either the aperture in said outer circumferential surface of the capstan or through the aperture in said first end of the capstan, and said capstan further having a pilot stub, said pilot stub being a substantially cylindrical shaft with a smooth outer surface extending outward from said first end of the capstan and oriented substantially perpendicular to said first end of the capstan, said pilot stub located substantially along the longitudinal axis of the capstan, said pilot stub having a diameter less than the diameter of the capstan; and said winding component further having a drive engagement component, said drive engagement component being in connection with said second end of the capstan, said drive engagement component suitably adapted to be engaged by a drive means such that said capstan is capable of being rotated by said drive means; and a wire guide, said wire guide being suitably adapted to engage the winding component and suitably adapted to guide the wire around the winding component, said wire guide comprising a first guide member and a second guide member, with said first and second guide members being substantially planar and constructed of a rigid material, with said first and second guide members oriented substantially parallel to each other and spaced apart from each other a distance just slightly greater than a diameter of the wire, creating an internal wire guide space, with said first guide member comprising an aperture, said aperture being substantially circular and having a diameter substantially the same as the diameter of the capstan and having a smooth inner surface;

with said second guide member comprising an aperture, said aperture being substantially circular, having a diameter substantially the same as the diameter of said capstan pilot stub, and having a smooth inner surface;

wherein the capstan is suitably adapted to being inserted into and through said aperture of said first guide member such that a portion of the capstan is retained in said aperture of said first guide member and another portion of the capstan extends into the internal wire guide space, with the capstan suitably adapted to rotate freely within said aperture of said first guide member without binding, and the capstan pilot stub is suitably adapted to being inserted into said aperture of said second guide member, with the capstan pilot stub suitably adapted to rotate freely within said aperture of said second guide member without binding, whereby the wire is wound into a substantially flat coil by first inserting the end of the wire into the receiving slot of the capstan and then rotating the capstan by the drive means.

2. The device of claim 1 wherein the first guide member of the wire guide is removably attached to the second guide member of the wire guide.

3. The device of claim 2 wherein the wire guide further comprises a plurality of spacers, with each said spacer having a first end, a second end, and a length substantially the same as that of each other spacer and just slightly greater than the diameter of the wire, each said spacer being located within the internal wire guide space, with the first end of each said spacer adjacent to the first guide member of the wire guide and the second end of each spacer adjacent to the second guide member of the wire guide;

whereby each said spacer is removably connected to either or both of the first and second guide members of the wire guide.

4. The device of claim 3 wherein each spacer is substantially cylindrical and comprises a central aperture passing completely through said spacer from the first end to the second end of said spacer, said central aperture being located along the longitudinal axis of said spacer, the first guide member comprises a plurality of connection apertures corresponding to the number of spacers, the second guide member comprises a plurality of connection apertures corresponding to the number of spacers, and the wire guide comprises a plurality of fasteners corresponding to the number of spacers;

whereby the plurality of connection apertures of the first guide member are aligned with the plurality of connection apertures of the second guide member and the plurality of spacers are interposed between the plurality of connection apertures of the first and second guide members, such that the central apertures of each spacer aligns with the corresponding connection apertures of the first and second guide members and each of said plurality of fasteners is suitably adapted to pass through one connection aperture of the first guide member, the central aperture of a corresponding spacer, and one corresponding connection aperture of the second guide member.

5. The device of claim 4 wherein each of the plurality of fasteners comprises a threaded bolt and a wing nut.

6. The device of claim 1 wherein one of the first and second guide members of the wire guide further comprises an extension suitably adapted to be engaged by a clamp.

7. The device of claim 1 wherein the drive means is one of the following group: an electric hand drill, a powered screw driver, an electric motor, and a hand operated crank.

8. The device of claim 1 wherein the second end of the capstan is substantially planar, and the drive engagement component of the winding component is a shaft, said shaft extending outward from the second end of the capstan and being oriented substantially perpendicular to the second end of the capstan, said shaft located substantially along the longitudinal axis of the capstan, said shaft suitably adapted to being engaged by the drive means.

9. The device of claim 8 wherein the shaft of the drive engagement component of the winding component has a hexagonal cross section.

10. The device of claim 8 wherein the drive means is an electric hand drill having a chuck, wherein the shaft of the drive engagement component of the winding component is suitably adapted to be inserted into and secured by the chuck of the electric hand drill.

* * * * *